US010881575B2

(12) United States Patent
Han et al.

(10) Patent No.: US 10,881,575 B2
(45) Date of Patent: Jan. 5, 2021

(54) SEATING-TYPE REHABILITATION ROBOT FOR WALKING

(71) Applicant: CUREXO, INC., Seoul (KR)

(72) Inventors: Jeongwoo Han, Seoul (KR); Younghwan Kim, Osan-si (KR); Dongmyung Min, Hwaseong-si (KR); Jeonghyun Lee, Tongyeong-si (KR)

(73) Assignee: CUREXO, INC., Seoul (KR)

( * ) Notice: Subject to any disclaimer, the term of this patent is extended or adjusted under 35 U.S.C. 154(b) by 505 days.

(21) Appl. No.: 15/575,475

(22) PCT Filed: Oct. 28, 2015

(86) PCT No.: PCT/KR2015/011443
§ 371 (c)(1),
(2) Date: Nov. 20, 2017

(87) PCT Pub. No.: WO2016/186270
PCT Pub. Date: Nov. 24, 2016

(65) Prior Publication Data

US 2018/0168908 A1 Jun. 21, 2018

(30) Foreign Application Priority Data

May 18, 2015 (KR) ..... 10-2015-0069017

(51) Int. Cl.
*A61H 3/00* (2006.01)
*A61H 1/02* (2006.01)

(52) U.S. Cl.
CPC ..... *A61H 3/008* (2013.01); *A61H 1/02* (2013.01); *A61H 1/0262* (2013.01); *A61H 3/00* (2013.01);
(Continued)

(58) Field of Classification Search
CPC . A61H 3/008; A61H 1/02; A61H 3/00; A61H 1/0262; A61H 2203/0406;
(Continued)

(56) References Cited

U.S. PATENT DOCUMENTS

2006/0097557 A1* 5/2006 Tholkes ..... A63B 23/03575 297/330
2006/0128537 A1* 6/2006 Philips ..... A61H 3/008 482/95
(Continued)

FOREIGN PATENT DOCUMENTS

CN 201907622 U 7/2011
JP 2000-210392 8/2000
(Continued)

OTHER PUBLICATIONS

International Search Report for International Application No. PCT/KR2015/011443, dated Mar. 2, 2016.
(Continued)

*Primary Examiner* — Quang D Thanh
(74) *Attorney, Agent, or Firm* — Novick, Kim & Lee, PLLC; Jae Youn Kim; Jihun Kim

(57) ABSTRACT

A walk rehabilitation robot includes a weight supporting part having an elevating and lowering part which is connected to a vertical supporting part and moves up and down, and a seating part which is connected to the elevating and lowering part for supporting a trainee who sits on the seating part; and a walk actuating part which is connected to the weight supporting part and is installed on the ground, with weight supporting links which are connected to footrests to train the walking of the trainee and which are separately mounted side by side on both side thereof. The walk actuating part includes a first actuating part for forward and backward movements according to the walk tracking of each footrest, a second actuating part for upward and downward move-
(Continued)

ments of the footrests caused by rotation of the weight supporting links, and a third actuating part for rotation of the footrests.

19 Claims, 16 Drawing Sheets

(52) U.S. Cl.
CPC ..... *A61H 2201/1642* (2013.01); *A61H 2201/1652* (2013.01); *A61H 2201/1659* (2013.01); *A61H 2203/0406* (2013.01); *A61H 2203/0431* (2013.01); *A61H 2230/80* (2013.01)

(58) Field of Classification Search
CPC .... A61H 2203/0431; A61H 2201/1652; A61H 2201/1642; A61H 2201/1659; A61H 2230/80
See application file for complete search history.

(56) References Cited

U.S. PATENT DOCUMENTS

2006/0229170 A1* 10/2006 Ozawa ..... A63B 21/00181 482/92
2008/0234113 A1* 9/2008 Einav ..... A61H 1/0237 482/66
2010/0248903 A1* 9/2010 Cardile ..... A61H 1/0262 482/51
2010/0298102 A1* 11/2010 Bosecker ..... A61H 1/0237 482/54
2013/0274640 A1* 10/2013 Butters ..... A61H 3/008 601/35
2014/0100491 A1 4/2014 Hu et al.
2015/0165265 A1* 6/2015 Tholkes ..... A63B 21/00185 482/54
2015/0250675 A1* 9/2015 Kalinowski ..... A61H 1/0262 482/69

FOREIGN PATENT DOCUMENTS

| | | | |
|---|---|---|---|
| JP | 2000-229108 | | 8/2000 |
| JP | 2006-006384 | | 1/2006 |
| KR | 10-0403672 | | 11/2003 |
| KR | 10-0976180 | | 8/2010 |
| KR | 10-1064891 | | 9/2011 |
| KR | 10-2015-0000312 | | 1/2015 |
| WO | 2005/074370 | A2 | 8/2005 |
| WO | 2009/035176 | A1 | 3/2009 |

OTHER PUBLICATIONS

Henning Schmidt, "HapticWalker—A novel haptic device for walking stimulation", Proceedings of EuroHaptics 2004, Jun. 5-7, 2004, pp. 60-67, Munich Germany.

* cited by examiner

SEATING-TYPE REHABILITATION ROBOT FOR WALKING

TECHNICAL FIELD

The present invention relates to the seating-type walk rehabilitation robot. More specifically, with the seating-type walk rehabilitation robot of the present invention, if a trainee on a saddle of a seating part lays foots on footrests, the footrest is moved along the walk tracking with a weight supporting link by a walk actuating part, which helps the walk training of the trainee such as a leg-paralyzed patient who needs the walk training.

BACKGROUND ART

Rehabilitation robot for walking is a kind of treatment device for rehabilitation treatment of paraplegia, stroke, brain damage, muscular atrophy, Parkinson's disease, Multiple sclerosis, cerebral palsy, erect sensory training and the like.

Conventional walk rehabilitation robot 100, as depicted in FIG. 1, has weight tow device of overhead harness to support the weight of a trainee.

The overhead harness is used to tow living things as well as human beings because it can tow the trainee upwards and the flexibility of the harness makes the movement of the towed object limited to the direction of gravity.

Korea Patent No. 0976180 and No. 0403672 disclose walk training robot for rehabilitation treatment of the patient with gait disturbance, operation method of the walk training robot, and measuring device to measure the walk-distance and walk-direction of the patient for the walk training robot.

To use the overhead harness makes some drawbacks that the time required to wear the overhead harness would be long, the large power would be applied to improper body spot long time by the weight of the patient while wearing the overhead harness, and some large space to set the overhead harness is needed.

DETAILED DESCRIPTION OF THE INVENTION

Technical Problem

An object of the present invention is to solve aforementioned problems, and to provide a seating-type walk rehabilitation robot to aid the walk training of the trainee with the weight supporting link and the footrest of a walk actuating part to walk-track move in the state that the weight of the trainee is supported by a weight supporting part elevated and lowered according to the build of the trainee supports.

Also, the present invention aims to move the trainee to the training position of the walk rehabilitation robot safely so as to provide a seating-type walk rehabilitation robot comprising a trainee moving part to have a tilting part, position adjusting part and guide part.

The present invention has a purpose to make a part of the footrest separated from the trainee's foot in case of emergency and make the power, which applied to the footrest by the foot, detected correctly by a footrest detecting part in the walk rehabilitation robot.

The present invention has another purpose to improve safety for falling accident in the walk rehabilitation robot, by fixing the upper body of the trainee with the weight supporting part which has a handle and a chest supporting part which the chest of the trainee lean on.

The present invention has another purpose to monitor the operation state of the walk rehabilitation robot with notice lamp to provide the information of the operation state and stop the operation with an emergency button on the walk rehabilitation robot.

Technical Solution

In order to achieve the above object, a seating-type rehabilitation robot for walking according to the present invention comprises: a weight supporting part comprising an elevating and lowering part which is connected to a vertical supporting part and moves up and down, and a seating part which is connected to the elevating and lowering part, and supporting a trainee who sits on the seating part; and a walk actuating part which is connected to the weight supporting part and is installed on the ground, with weight supporting links which are connected to footrests to train the walking of the trainee and which are separately mounted side by side on both side thereof, the walk actuating part comprising first actuating part for forward and backward movement according to the walk tracking of each footrest, second actuating part for upward and downward movements of the footrests caused by rotation of the weight supporting links, and third actuating part for rotation of the footrests.

Advantageous Effects of the Invention

According to the seating-type rehabilitation robot for walking of the present invention, it is possible to do the walk training with supporting the weight of the trainee and adjusting the height of the seat saddle. Also, to use a connecting frame as the weight supporting part with the saddle makes the time required to wear/take off shortened relative to conventional walk training device with the overhead harness. In addition, the conventional weigh tow device of the overhead harness type would need ceiling construction to enlarge the installment space when the conventional rehabilitation robot is installed, but the rehabilitation robot of the present invention needs not remodel the ceiling because the installment height of the rehabilitation robot of the present invention is low.

In outbreak situation such as abnormal operation of the walk rehabilitation robot, the ankylosis of the patient and so on, the rehabilitation robot of the present invention reduces the risk of the ankle injury of the patient so as to enhance the safety and the marketability. Advantageously, the force applied to the footrest during the walk training is detected firmly and then is feed to the rehabilitation treatment.

The upper body of the trainee is able to be fixed by the handle and the chest supporting part and therefore the accident such like the trainee's falling can be effectively prevented in advance.

Also, it is possible to monitor the operation state of the walk rehabilitation robot with the notice lamp during the walk training and to take prompt action for the abnormal operation of the walk rehabilitation robot by stopping the operation with the emergency button.

MODE FOR EMBODIMENT OF THE INVENTION

Hereinafter, exemplary embodiments of the seating-type walk rehabilitation robot according to the present invention will be described in detail referring to the appended drawings. The present invention is not limited to the embodiments that will be described below and can be implemented in different ways. These embodiments are provided only to explain the present invention and to tell the scope of the invention to those of ordinary skill in the art.

Figure 1:
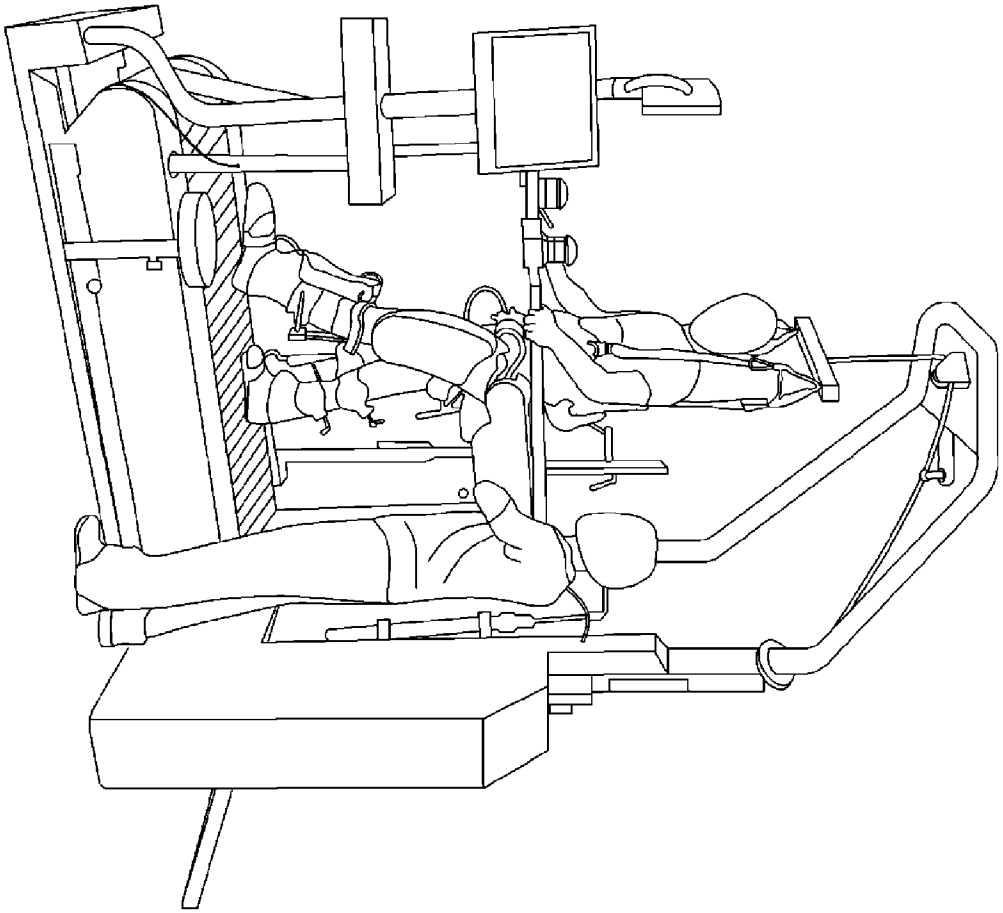
FIG. 1 (PRIOR ART)
FIG. 1 is a perspective view of the conventional walk training device.
Figure 2:
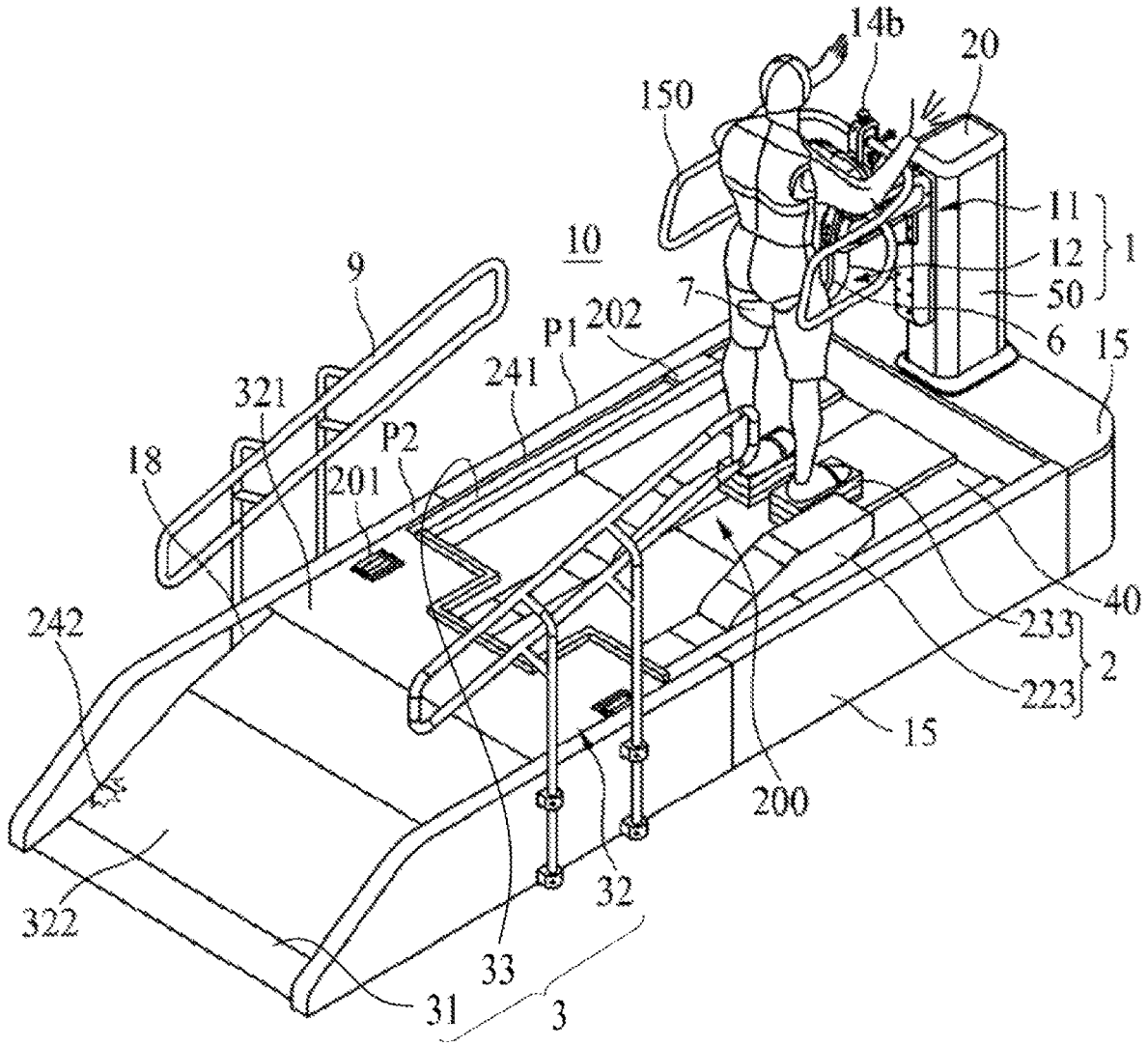
FIG. 2 is a perspective view of the seating-type walk rehabilitation robot according to the present invention.
Figure 3:
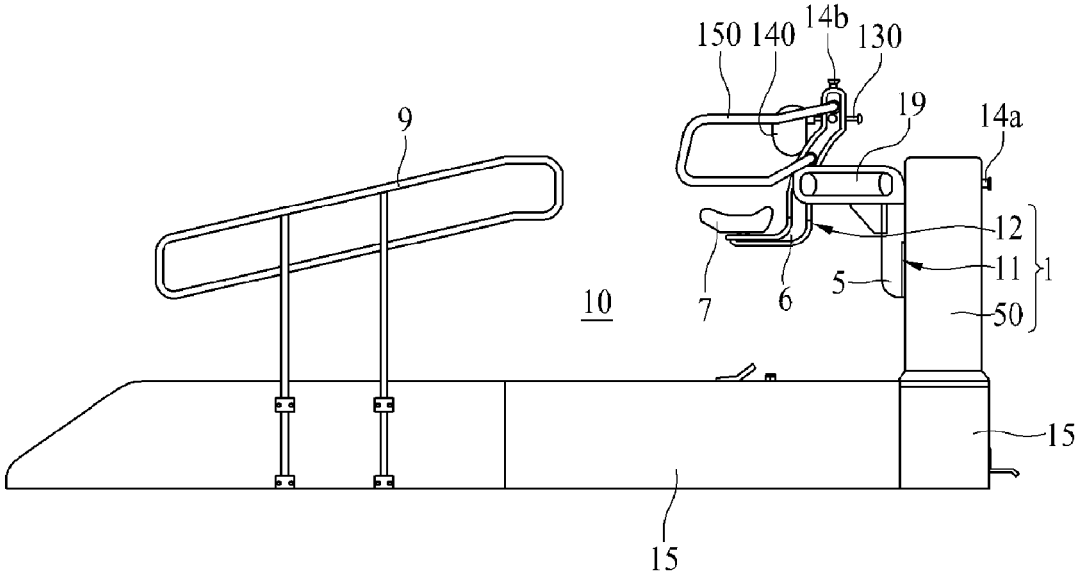
FIG. 3 is a right side view of the seating-type walk rehabilitation robot according to the present invention.
Figure 4:
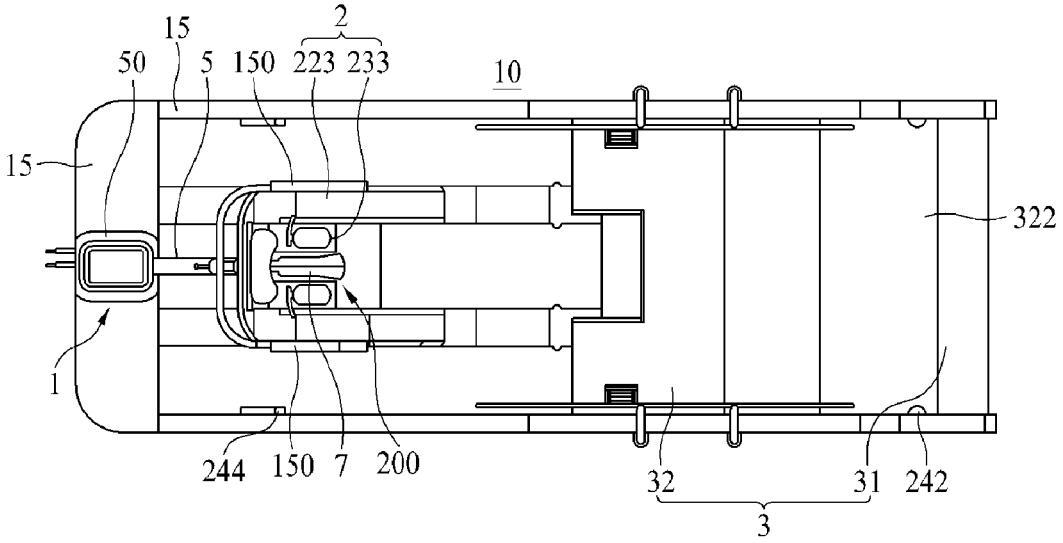
FIG. 4 is a planar view of the seating-type walk rehabilitation robot according to the present invention.

FIG. 2, FIG. 3, and FIG. 4 are a perspective view, a right side view, and a planar view of the seating-type walk rehabilitation robot according to the present invention, respectively.

Figure 5:
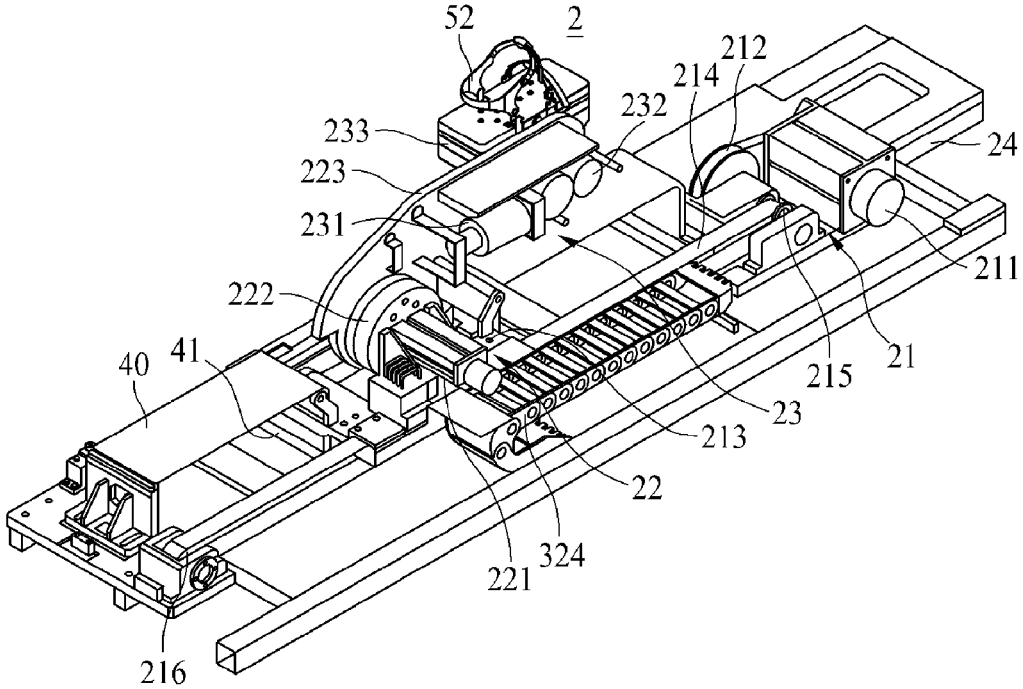
FIG. 5 is a perspective view of one-side walk actuating part of the seating-type walk rehabilitation robot according to the present invention.

As illustrated in FIG. 2-4, the seating-type walk rehabilitation robot 10 according to the present invention comprises a weight supporting part 1, a walk actuating part 2 which is depicted in FIG. 5, and a trainee moving part 3.

Here, general well-known parts such like power source, connecting line and so on which are able to be used for the walk rehabilitation robot would be optionally applied to the walk rehabilitation robot 10 but not explained.

The weight supporting part 1 comprises an elevating and lowering part 11 and a seating part 12, wherein the elevating and lowering part 11 has an elevating and lowering frame 5 connected to a vertical supporting part 50 and an elevating and lowering block 245 connected to the elevating and lowering frame 5 inside the vertical supporting part 50. Also, the seating part 12 has a connecting frame 6 connected to the elevating and lowering frame 5 and saddle 7 installed on the connecting frame 6.

The walk actuating part 2 is covered by an outer cover 15 adhered to the left/right and front sides of the walk actuating part 2. In front of the walk actuating part 2, the weight supporting part 1 is installed with standing and in the rear of the walk actuating part 2, the trainee moving part 3 for moving the trainee is installed. Also, a notice lamp 20 is installed inside the upper part of the vertical supporting part 50 where the elevating and lowering part 11 of the weight supporting part 1 is installed, and emits the light of the various colors through circumferential opening. An emergency button 14*a* is installed in front side of the vertical supporting part 50 of the weight supporting part 1. For example, when the notice lamp 20 emits green light, normal operation state is noticed and when the notice lamp 20 emits red light, the operation would be stopped automatically or manually by a guardian's or the trainee's pushing the emergency button 14*a* on recognizing the abnormal operation state.

The trainee moving part 3 has a tilting part 31 installed in the rear of the walk actuating part 2, a position adjusting part 32 installed on the walk actuating part 2, and a guiding part 33 guiding the movement of the position adjusting part 32.

The tilting part 31 is installed in the walk actuating part 2 to move the trainee to walk training space 200 above the walk actuating part 2. The tilting part 31 connects the walk actuating part 2 and ground. The trainee can move to the walk training space 200 above the walk actuating part 2 through the tilting part 31.

The position adjusting part 32 is installed on the walk actuating part 2 so that the trainee could move between movement position P1 for the trainee to move to the walk training space 200 and training position P2 for the trainee to perform the walk training. For example, in case the trainee must move to the walk training space 200 and the position adjusting part 32 is located in the movement position 31, the trainee on the wheelchair or with help of other person can move to the walk training space 200 through the tilting part 31 and the position adjusting part 32. The trainee is positioned in the walk training space 200 and sits on the saddle 7, and then the position adjusting part 32 can move to the training position P2. Here, the trainee moving part 3 would comprise a gripping part 201 formed in the position adjusting part 32.

The gripping part 201 would be formed as hole or groove in the position adjusting part 32. That is, the gripping part 201 would be formed to be hollowed to the direction from the position adjusting part 32 to the walk actuating part 2. So, if a training assistant moves with gripping the gripping part 201, then the position adjusting part 32 would be moved. By this structure, the walk rehabilitation robot 10 according to the present invention can prevent the interference of the movement path and the gripping part 201 when the trainee moves to the position adjusting part 32, compared with the outer extending structure of the gripping part 201.

The guiding part 33 guides the movement of the position adjusting part 32. The guiding part 33 could be installed in the walk actuating part 2. The guiding part 33 guides the position adjusting part 32 to move in the movement direction vertical to the gravity. Here, the position adjusting part 32 moves according to the guide of the guiding part 33 and then would be located in the training position P2 and on the upper side of the tilting part 31.

Therefore, the walk rehabilitation robot 10 according to the present invention enhances the effects bellowed.

First, the walk rehabilitation robot 10 according to the present invention has the position adjusting part 32 moving to the direction vertical to the gravity and therefore prevents the weight of the position adjusting part 32 injuring the operator, compared to moving to the direction of the gravity. In addition, the walk rehabilitation robot 10 according to the present invention prevents some disease such like the musculoskeletal system disorder during the walk training and some accident for the operator.

Second, the walk rehabilitation robot 10 according to the present invention permits the walk training in the state of the movement completion of the position adjusting part 32 and therefore prevents the walk actuating part 2 and the position adjusting part 32 conflicting each other. In addition, because the walk rehabilitation robot 10 according to the present invention gets large walking range, the efficiency of the walk training for the operator is enhanced.

The position adjusting part 32 comprises the flat plate part 321 and connecting part 322.

The flat plate part 321 is installed in the guiding part 33 and supports the trainee. The flat plate part 321 is moved with the guiding part and located in one of the movement position P1 and the training position P2. In the one side of the flat plate part 321, the connecting part 322 is installed. So, if the flat plate part 321 is located in the movement position P1, the trainee can move to the walk training space 200 through the tilting part 31, the connecting part 322 and the flat plate part 321. The gripping part 201 could be formed in the flat plate part 321.

The connecting part 322 connects the flat plate part 321 and the tilting part 31. The connecting part 322 might be installed in the flat plate part 321 with hinge. In this case, as the flat plate part 321 moves to the movement position P2, the connecting part 322 could move together. The connecting part 322 is installed in the flat plate part to be declined from the direction of the flat plate part 321 to the direction of the tilting 31. In this case, the connecting part 322 is located at the front end of the tilting part 31 in series, and the trainee might be located on the flat plate part 321 through the connecting part 322 via the tilting part 31.

In the case that the flat plate part 321 moves from the movement position P1 to the training position P2, the connecting part 322 installed in the flat plate part 321 is able to move with being in contact with the tilting part 31. Thus, the walk rehabilitation robot 10 according to the present invention has the position adjusting part 32 move with using the gravity and sliding in the movement direction, and therefore prevents the weight of the position adjusting part 32 injuring the operator, compared with moving in the direction of the gravity. In addition, the walk rehabilitation robot 10 according to the present invention prevents some disease such like the musculoskeletal system disorder and some accident for the operator during the walk training.

The guiding part 33 comprises a guide rail 241 for providing the moving path of the position adjusting part 32 and a roller part 242 installed in the position adjusting part 32. The guide rail 241 is installed in the outer cover 15 and provides the moving path of the position adjusting part 32. For example, the flat plate part 321 moves along the guide rail 241 to be located in one of the movement position P1 and the training position P2. Thus, as the flat plate part 321 moves along the guide rail 241, the connecting part 322 moves with being in contact with the tilting part 31.

The roller part 242 is installed in the position adjusting part 32 to be rotated as the position adjusting part 32 moves. For example, the roller part 242 is able to rotate in the direction of the movement of the flat plate part 321 and the connecting part 322 as the flat plate part 321 and the connecting part 322 moves. Thus, the walk rehabilitation robot 10 according to the present invention is implemented that the rotation of the roller part 242 assists the movement of the position adjusting part 32. Therefore, the walk rehabilitation robot 10 according to the present invention reduces the power required to move the position adjusting part 32 and transfers the position adjusting part 32 with small power. In addition, the walk rehabilitation robot 10 according to the present invention prevents the injury of the operator while transferring the position adjusting part 32.

The guiding part 33 might comprise second fixing part 243 formed to be located in at least one of the movement position P1 and the training position P2, and a fixing member 244. In this case, the trainee moving part 3 might comprise first fixing part 203 installed in the position adjusting part 32.

The second fixing part 243 is installed in the guide rail 241. The second fixing part 243 might be installed in the guide rail 241 to be located in at least one of the movement position P1 and the training position P2. Also, the second fixing part 243 might be formed to have the shape of hole or groove.

The first fixing part 203 is installed in the position adjusting part 32. As the position adjusting part 32 moves, at each of the movement position P1 and the training position P2 the first fixing part 203 might be located in position corresponding to the second fixing part 243. The first fixing part 203 is formed in the position adjusting part 32 to have the shape of hole.

The fixing member 244 is able to fix the position adjusting part 32. As the position adjusting part 32 moves, the fixing member 244 can be inserted into the second fixing part 243 and the first fixing part 203 in the movement position P1. In this case, the fixing member 244 can fix the position adjusting part 32 in the movement position P1. Also, the fixing member 244 can be inserted into the second fixing part 243 and the first fixing part 203 in the training position P2. In this case, the fixing member 244 can fix the position adjusting part 32 in the training position P2.

Thus, the walk rehabilitation robot 10 according to the present invention prevents the position of the position adjusting part 32 changing randomly while the trainee is located on the position adjusting part 32. Therefore, the walk rehabilitation robot 10 according to the present invention prevents the trainee falling while sitting in the saddle 7 or moving to the walk training space 200. In addition, the walk rehabilitation robot 10 according to the present invention prevents some accident of the trainee during the walk training.

Here, the trainee moving part 3 might comprise the stopper 202 installed in the guiding part 33.

The stopper 202 might contact with the position adjusting part 32 and stop the movement of the position adjusting part 32 as the position adjusting part 32 is located in the movement position P1. For this, the stopper 202 might be installed in the outer cover 15 to be located in the movement position P1. The stopper 202 could be formed with material such like urethane to absorb the impact and reduce the noise. Also, the stopper 202 might has an elastic member such like a spring to absorb the impact resulted from the confliction with the position adjusting part 32. Therefore, the walk rehabilitation robot 10 according to the present invention can reduce the impact and the noise occurring in the guiding part 33 while the position of the position adjusting part 32 moves to the movement position P1.

A detecting sensor 18 is installed in the rear end of the guiding part 33 to contact with the rear end of the flat plate part 321 of the position adjusting part 32. The detecting sensor 18 makes the walk actuating part 2 operate only when detecting the contact with the rear end of the flat plate part 321 of the position adjusting part 32, which prevents the accident resulted from the operation of the walk actuating part 2 in the state that the flat plate part 321 of the position adjusting part 32 is located in the walk training space 200. The detecting sensor might be the detecting device of the trainee moving part, which is installed in the guiding part 33 to recognize the operable state of the walk rehabilitation robot that the position adjusting part 32 of the trainee moving part 3 gets out of the walk training space 200 and is in the training position P2.

The walk actuating part 2 comprises a couple of weight supporting links 223 and footrests 233, first actuating part 21, second actuating part 22, and third actuating part 23. Here, the couple of the weight supporting links with predetermined length are separately installed side by side on both rear sides of the weight supporting part 1. The couple of footrests are installed to face each other, where one footrest is at right side of end of one weight supporting link 223 and the other footrest is at left side of end of the other weight supporting link 223. Hereinafter, the parts and the actuation of the walk actuating part 2 will be explained concretely.

Actuating control parts are installed inside the walk actuating part 2 and the weight supporting part 1 to co-work through communication device and signal input/output device, transfer interlock control and actuation command via whole controller of high layer, and comprise processor, drive and the like for controlling the walk actuating part 2 and the weight supporting part 1.

The elevating and lowering frame 5 of the elevating and lowering part 11 is connected to the rear of the weight supporting part 1, and is elevated/lowered with the connecting frame 6 having the saddle 7 by lead screw, elevating and lowering block and the like installed inside the vertical supporting part 50 of the weight supporting part 1. Hereinafter, the composition and the operation about this will be explained in detail.

The connecting frame 6 of the seating part 12 in the state that the saddle is installed under the connection frame 6 is connected to one end of the weight detecting part 8 which is connected to the elevating and lowering frame 5, and an emergency button 14 *b* is installed in the connecting frame 6 to stop the abnormal operation of the walk rehabilitation robot 10.

The saddle 7 of the seating part 12 is installed to be left/right rotatable with supporting the weight in the state that the trainee sits on the saddle 7. The saddle 7 is preferably permitted to rotate left and right within predetermined range in order not to burden the trainee with excessive rotation. That is, the movement of the pelvis during the walk training becomes natural or free compared to the state that the saddle 7 is fixed. In the frontal upper part of the connecting frame 6, a chest supporting part 140 to support the trainee's chest is installed with an adjusting link 130 to be inserted. In the both sides of the connecting frame 6, handles 150 are installed.

The weight detecting part 8 comprises a force sensor or load cell inside the elevation and lowering frame 5 connected to connecting frame 6. That is, the weight detecting part 8 is installed in one end of the elevation and lowering frame 5 which is in the direction of the connecting frame 6, and one side of the weight detecting part 8 is connected to the connecting frame 6 so that the weight and the force of the trainee applied to the saddle 7 is transferred to the weight detecting part 8 via the connecting frame 6. To hide the weight detecting part 8, a cover 19 might be installed in one end of the elevating and lowering frame 5 around the weight detecting part 8.

A handle frame 9 is installed in the outer cover 15. The handle frame 9 might be installed to have an inclination as the same of the tilting part 31. The trainee can move to the walk training space 200 along the tilting part 31 and the position adjusting part 32 in the movement position P1 with gripping the handle frame 9. Thus, the walk rehabilitation robot 10 according to the present invention is implemented to make the trainee move to the walk training space 200 with gripping the handle frame 9 and therefore prevents the trainee from falling. In addition, the walk rehabilitation robot 10 according to the present invention contributes to prevent the accident for the trainee during the walk training.

Figure 6:
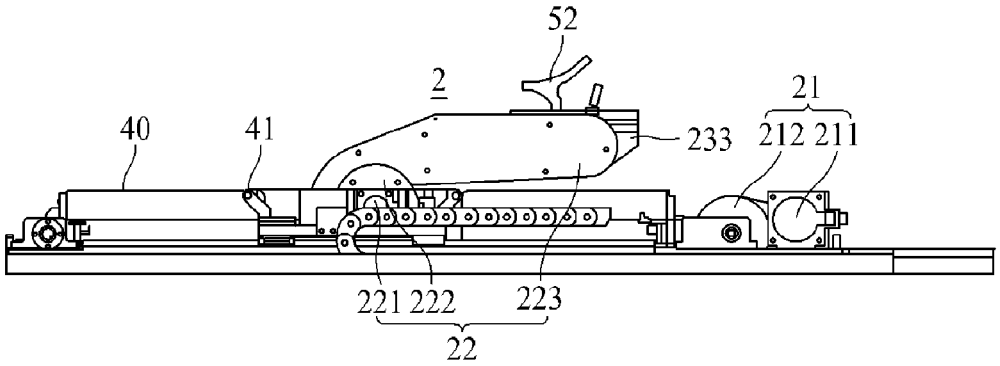
FIG. 6 is a right side view of one-side walk actuating part of the seating-type walk rehabilitation robot according to the present invention.
Figure 7:
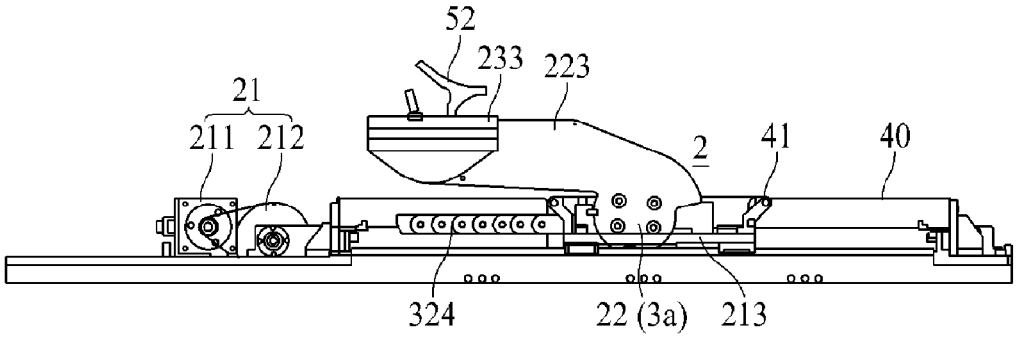
FIG. 7 is a left side view of one-side walk actuating part of the seating-type walk rehabilitation robot according to the present invention.

FIG. 5-7 are a perspective view, a right side view, and a left side view of one-side walk actuating part of the seating-type walk rehabilitation robot according to the present invention, respectively.

As illustrated in FIG. 5-7, the walk actuating part 2 of the walk rehabilitation robot 10 according to the present invention comprises one couple of weight supporting links 223 and footrests 233, the first actuating part 21, the second actuating part 22, and the third actuating part 23, which is mentioned above. In FIGs, only the right walk actuating part 2 of the walk rehabilitation robot 10 is depicted, but the left walk actuating part 2*a* has the same.

The weight supporting link 223 is one part of the second actuating part 22 and is installed on the upper surface of the first actuating table 213, which is one part of first actuating part 21 of the walk actuating part 2. In the end side of the weight supporting link 223, the footrest 233 is installed.

The first actuating part 21 of the walk actuating part 2 comprises first motor 211 installed in the walk actuating part frame 24, first reducing device 212 having things such as a reducer or a pulley connected to the output of the first motor, first driving pulley 215 installed in the output of the first reducing device 212, first driven pulley 216 installed in the walk actuating part frame 24 and having the separate distance with the first driving pulley 215, the first actuating table 213 driven in the directions of the front and the rear of the walk actuating part frame 24 and having the weight supporting link 223 with the footrest 233 on the upper surface, first linear actuating belt 214 connecting one end of the first actuating table 213 to the first driving pulley 215, and the other end of the first actuating table 213 to the first driven pulley 216 for making the forward and backward drive of the first actuating table 213. Here, the first driving pulley 215 shares the axis with the output of the first reducing device 212 to rotate synchronously.

Thus, the drive of the first motor 211 of the first actuating part 21 is transferred to the first actuating table 213 via the first reducing device 212, the first driving pulley 215, and the first linear actuating belt 214, and therefore the weight supporting link 223 moves straightly forwards and backwards with the footrest 233.

The second actuating part 22 of the walk actuating part 2 comprises second motor 221 installed in the first actuating table 213 and interlocked with the forward/backward movement of the first actuating table 213, second reducing device 222 connected to the output of the second motor 221, and the weight supporting link 223. One end of the weight supporting link 223 is connected to the output of the second reducing device 222. Also, in the other end of the weight supporting link 223 the footrest 233 is installed, and inside the weight supporting link 223 the third actuating part 23 is installed. The weight supporting link 223 can rotate independent of the forward and backward drive of the first actuating part 21. A cableveyor 324, where various cables to feed the electric power to the walk actuating part 2 is inserted safely, is installed in the opposite side of the second motor 221 connected to the second reducing device 222.

Thus, the drive of the second motor 221 of the second actuating part 22 is transferred to the weight supporting link 223 via the second reducing device 222, so that the front part of the weight supporting link 223 goes up and down and as a result the weight supporting link 223 rotates with the footrest 233.

The third actuating part 23 of the walk actuating part 2 comprises third motor 231 installed in the middle inside the weight supporting link 223, third reducer 232, and the footrest 233. The third reducer 232 is connected to the third motor 231 and the output of the third reducer 232 is connected to the side of the footrest 233 so that the footrest 233 can rotate relative to the weight supporting link 223.

Thus, the drive of the third motor 231 of the third actuating part 23 is transferred to the footrest 233 via the third reducer 232, so that the footrest 233 would rotates as mentioned above.

The walk actuating part 2 with the first actuating part 21 and second actuating part 22 actuates the walk tracking movement that as one footrest 233 moves upwards and a little backwards, the other footrest 233 moves downwards and a little forwards, and in contrast, as one footrest 233 moves downwards and a little forwards, the other footrest 233 moves upwards and a little backwards. In addition, with the third actuating part 23, the footrest 233 rotates to train the normal walking that the foot heel contacts with the ground and then the toe contacts with the ground while walking.

The walk actuating part 2 comprises a sealing belt 40 to cover the motors, reducer and the like, because it might cause any accident and look bad. That is, the sealing belt 40 is installed between rollers 41 provided at the front and the rear of the first actuating table 213 to pass and cover the frontal upper part of the walk actuating part 2, the lower part of the first actuating table 213 and the rear upper part of the walk actuating part 2.

Figure 8:
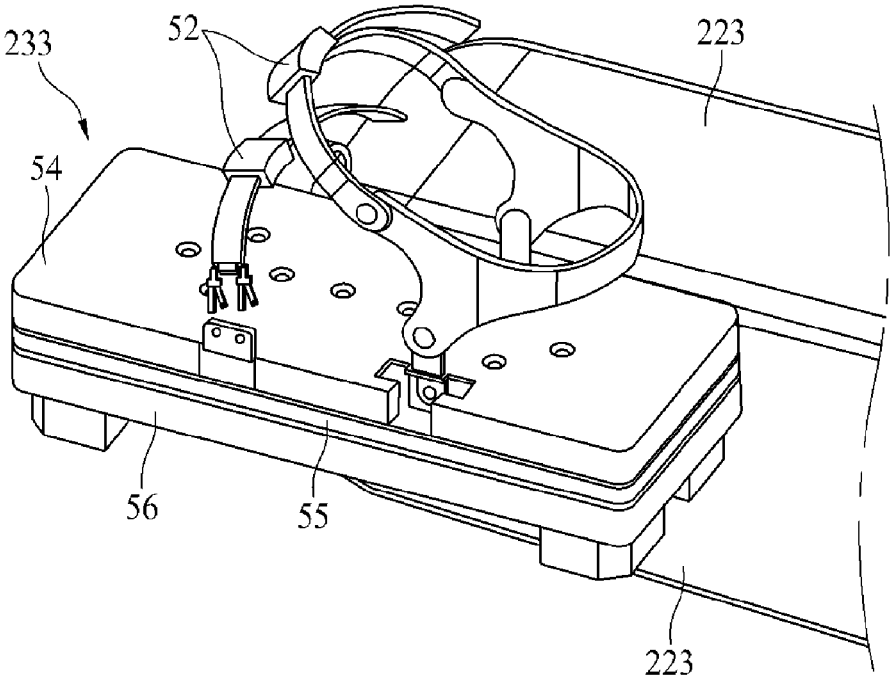
FIG. 8 is a perspective view of the footrest of the seating-type walk rehabilitation robot according to the present invention.
Figure 9:
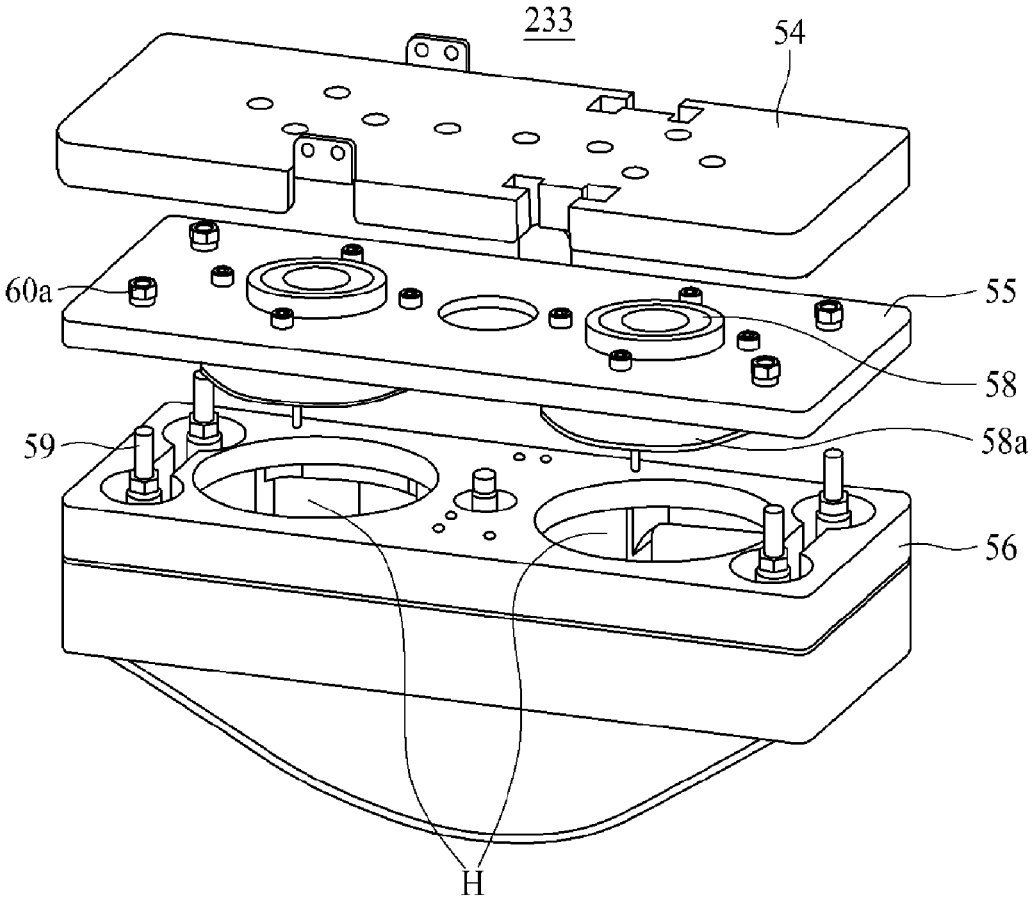
FIG. 9 is a disassemble perspective view of the footrest of the seating-type walk rehabilitation robot according to the present invention.

FIG. 8 is a perspective view of the footrest of the seating-type walk rehabilitation robot according to the present invention and FIG. 9 is a disassemble perspective view of the footrest of the seating-type walk rehabilitation robot according to the present invention.

As illustrated in FIGS. 8 and 9, the footrest 233 of the walk rehabilitation robot according to the present invention is rectangle plate consisting of upper plate 54, middle plate 55 and lower plate 56. In the upper surface of the upper plate 54 a fix band 52 to fix the patient's foot, and on the lower surface of the upper plate 54 each of steel blocks is installed to extend outer in separate 2 locations of both side directions of the longitudinal upper plate 54. In the position on the upper surface of the middle plate 55 corresponding to the steel blocks 57 having extending part 58 a is installed to stick to the steel block 57 with the electromagnetic force and therefore connect the upper plate 54 and the middle plate 55. The electromagnet 58 has somewhat thickness to extend downwards though middle plate 55. Also, a contact part 60 to contact with the load cell 59 is installed in the 4 corners of the middle plate 55 and connected to the nut and urethane washer (refer to FIG. 10).

About the lower plate 56, through holes H, where the electromagnet 57 with the extending part 58*a* is inserted, are formed side by side in the positions corresponding to the electromagnets 58. In 4 corners of the lower plate 56, the load cells 59 are installed to contact the contact part 60, respectively. The load cells 59 extends from the upper surface of the lower plate 56 and thus the middle plate 55 and the lower plate 56 are connected with a little separate distance. A combining part 513 to be combined with the output of the third reducer 232 of the weight supporting link 223 of the walk rehabilitation robot 10 lies on the lower surface between the through holes H.

The footrest 233 of the walk rehabilitation robot 10 according to the present invention In outbreak situation such as abnormal operation of the walk rehabilitation robot, the ankylosis of the patient and so on, if the force more than a threshold is applied to the footrest 233 fixing the patient's foot, then the load cells 59 detect the force through the contact part 60 and makes the electromagnet 59 on the upper surface of the middle plate 55 provided with current so that the electromagnet 59 loses the electromagnetic force and the upper plate 54 is separated from the middle plate 55, which is controlled by the controller. Therefore, the used electromagnet 59 is chosen to emit the electromagnetic force when no current is provided so that the upper plate 54 and the middle plate 55 are combined each other. Also, a union state detecting sensor 51 (refer to FIG. 11) such as a contact detecting sensor might be installed in the footrest 233 to recognize the abnormal state that the upper plate 54 is separated from the middle plate 55.

Figure 10:
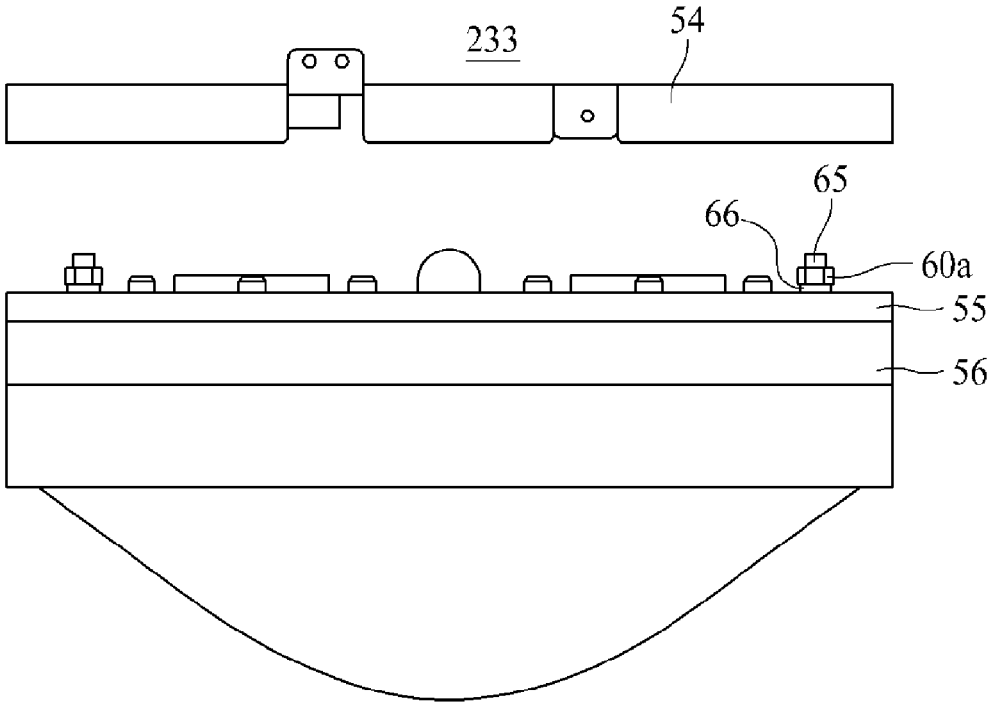
FIG. 10 is an assembled side view of the footrest of the FIG. 9.
Figure 11:
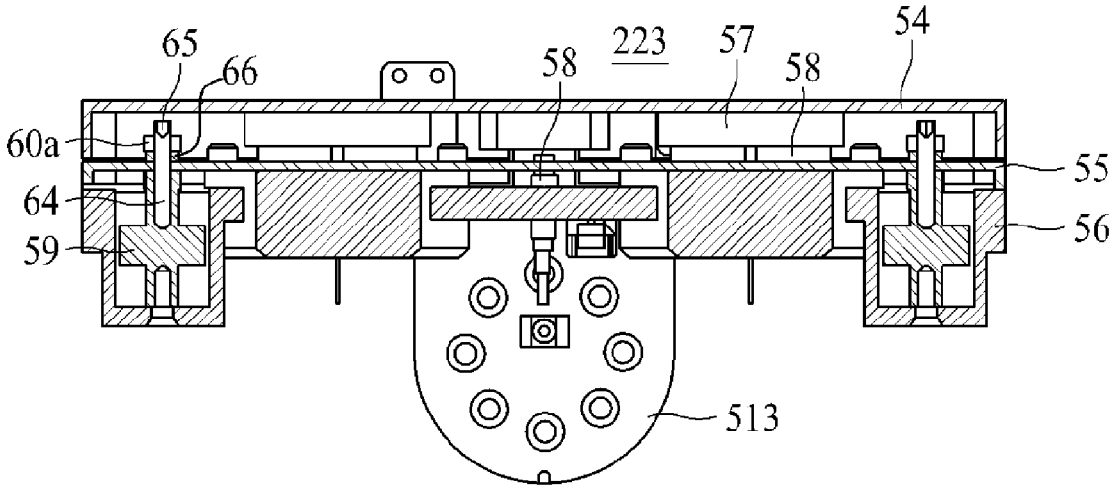
FIG. 11 is a longitudinal sectional view of the FIG. 10.

FIG. 10 is an assembled side view of the footrest of the FIG. 9 and FIG. 11 is a longitudinal sectional view of the FIG. 10.

As illustrated in FIGS. 10 and 11, the upper plate 54, the middle plate 55, and the lower plate 56 of the rectangle plate shape are overlaid to form the footrest assemble in FIG. 9. In the state that the middle plate 55 and the lower plate 56 are separated with a gap and the footrest detecting parts 65 are installed to extend upward on 4 corners of the upper surface of the lower plate 56 respectively, the lower part of the footrest detecting parts 65 is installed firmly with the nut 60*a*, urethane washer 60*b* and bolt 64 and elastic member 66 of washer shape and nut 60*a* are inserted between the upper part of the extended footrest detecting part 65 and the middle plate 55. In other words, the upper part of the footrest detecting part 65 is contacted with the lower surface of the middle plate 55, and the upper surface of the middle plate 55 and bolt 64 to press the upper surface of the middle plate 55 is intervened with the elastic member 66 of the washer shape. In addition, the union state detecting sensor 51 is installed inside the footrest 233, the load cells 59 are installed inside the 4 corners of the lower plate 56 connected to the footrest detecting part 65, and the electromagnet 58 on the upper surface of the middle plate 55 sticks to the steel block 57 on the lower surface of the upper plate 54, as mentioned above.

In the state that the upper part of each footrest detecting part 65 is inserted into by the elastic member 66, the upper plate 54 is overlaid on the middle plate 55 and the elastic member 66 are fixed in the four positions on the lower surface of the upper plate 54 to complete the footrest 223. Therefore, the upper plate 54 and the lower plate 56 is not separated by intervening the multiple elastic members 66 to have the footrest detecting part 65 insides between the upper plate 54 and the middle plate 55 and overlaying each other.

As the elastic member 66, natural rubber, synthetic rubber, or any elastic resin including the urethane is usable.

Because in the footrest 233 of the walk rehabilitation robot 10 according to the present invention the elastic member 66 is inserted between the middle plate and load cell 59, the force applied on the upper plate by the press of the foot is well transferred to the load cell 59 though the middle plate 55. In other words, when the force is transferred to the load cell 59 form the middle plate 55, moment as well as vertical directional force is transferred in the state that the middle plate 55 and the footrest detecting part 65 are firmly connected, and the moment acts as noise. However, in the case the elastic member 66 is inserted as the present invention, the rigidity of the elastic member 66 is negligible relative to that of the middle plate 55 and the footrest detecting part 65 and therefore the elastic member 66 absorbs the moment with being transformed and only the force is transferred to the footrest detecting part 65. Also the elastic member 66 prevents the separation of the middle plate 55 and the lower plate 56.

Thus, although the middle plate 55 and the lower plate 56 is overlaid and fixed with the separation distance, the footrest detecting part 65 is not moved and transformed by the elastic member 66. As the middle plate 55 is curved by the force which is applied on the upper plate 54 and transferred to the middle plate 55, the moment is not transferred to the footrest detecting part 65 and therefore the footrest detecting part 65 can detect and measure accurately the force pressing the footrest.

The footrest 233 with the elastic member 66 has been explained to be used for the walk rehabilitation robot 10 of the present invention, but is applicable for the footrest of the force-based various robots such as exoskeleton robot, walk analysis robot and the like.

Figure 12:
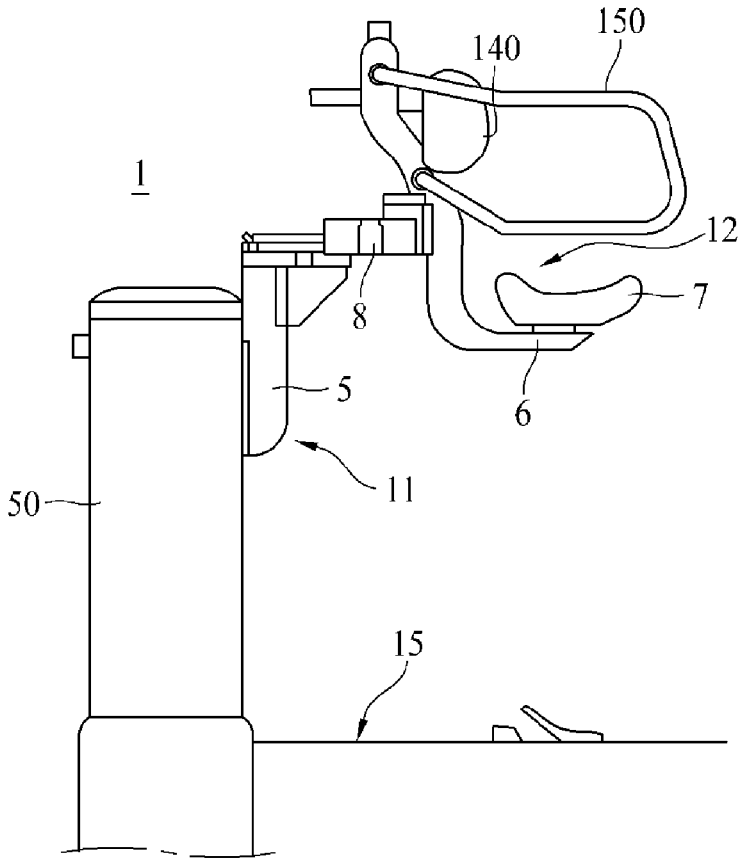
FIG. 12 is a side view of the weight supporting part of the seating-type walk rehabilitation robot according to the present invention.
Figure 13:
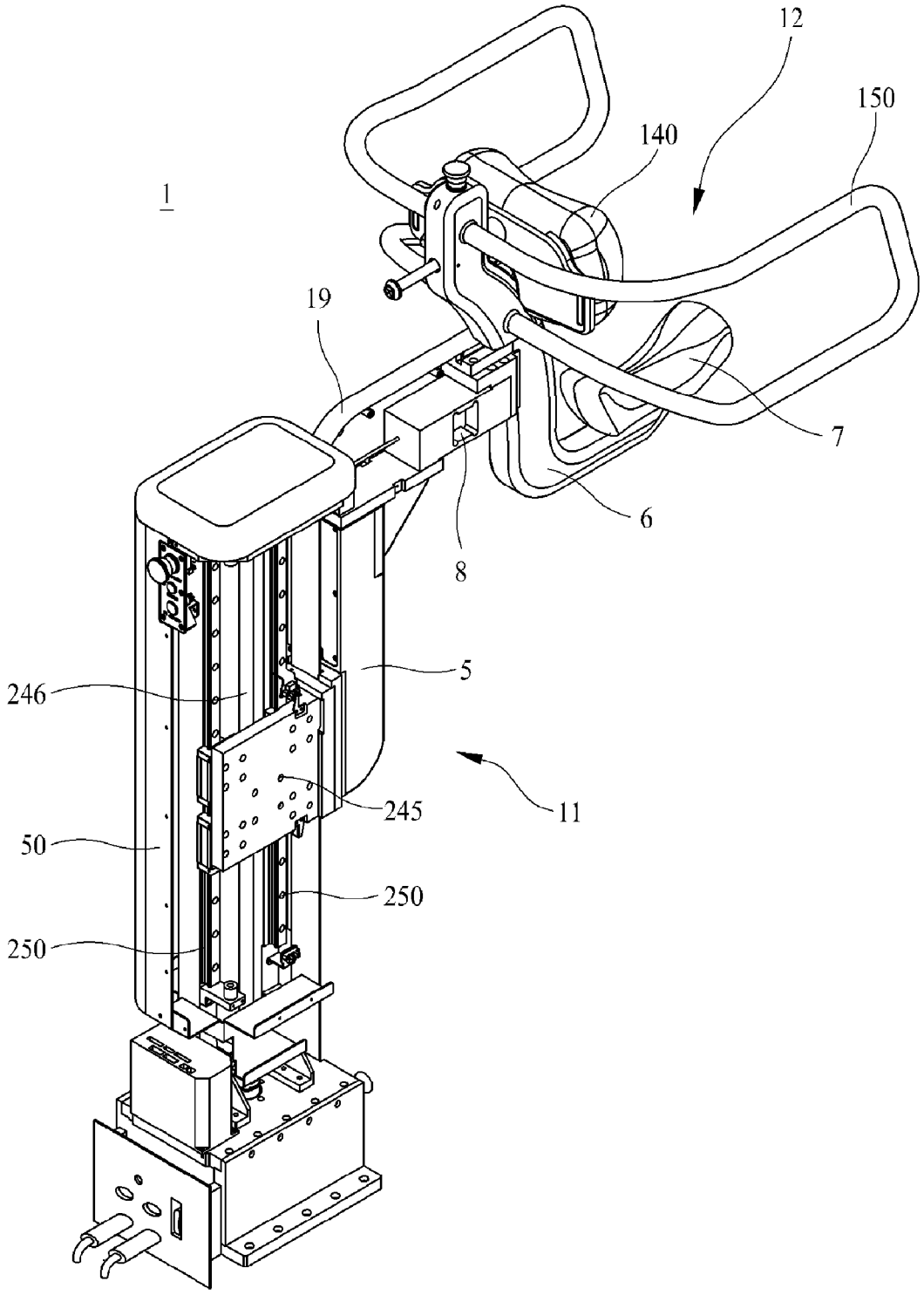
FIG. 13 is a perspective view inside the weight supporting part of the seating-type walk rehabilitation robot according to the present invention.

FIG. 12 is a side view of the weight supporting part of the seating-type walk rehabilitation robot according to the present invention and FIG. 13 is a perspective view inside the elevating and lowering part of FIG. 12.

As illustrated in FIG. 12 and FIG. 13, in order to support the saddle 7 of the seating part 12 in the vertical supporting part 50 of the weight supporting part 1, the walk rehabilitation robot according to the present invention has the elevating and lowering frame 5 of the elevating and lowering part 11 intervened between the vertical supporting part 50 and the saddle 7 connected with the connecting frame 6. To explain in detail, one side part of the elevating and lowering frame 5 is supported by the vertical supporting part 50 of the weight supporting part 1 and the other side part of the elevating and lowering frame 5 extends outside the weight supporting part 1 to be in the direction of the walk actuating part 2. The other side part of the elevating and lowering frame 5 is connected to the connecting frame 6 where the saddle 7 is installed.

The weight detecting part 8 such as the force sensor, load cell, or the like is located inside the elevating and lowering frame 5 connected to the connecting frame. That is, the weight detecting part 8 is installed in the end of the elevating and lowering frame 5 in the direction of the connecting frame 6, and covered. As the weight detecting part 8 is connected with the connecting frame 6, the weight and the force of the rehabilitation patient applied to the saddle 7 is transferred to the weight detecting part 8 through the connecting frame 6.

To control the height of the saddle 7 according to the physical characteristic of the patient, the elevating and lowering frame 5 of the elevating and lowering part 11 is implemented to be able to elevate and lower. For this, a lead screw 246 and an elevating and lowering block 245 are provided. The lead screw 246 is installed to face the upper and low direction parallel to the vertical supporting part 50 of the weight supporting part 1 and to rotate inside the vertical supporting part 50 of the weight supporting part 1. The elevating and lowering block 245 is engaged with the lead screw 246 with covering the lead screw 246. One side surface of the elevating and lowering block 245 is connected to the elevating and lowering frame 5 and thus as the lead screw 246 is controlled to rotate normally or reversely by an actuator (not illustrated) such as a motor and the like, the elevating and lowering block 245 is elevated or lowered along the lead screw 246 and sequentially the elevating and lowering frame 5 and the saddle connected to the elevating and lowering frame 5 with the connection frame 6 are elevated or lowered.

Because the saddle 7 is elevated or lowered along the elevating and lowering frame 5 with connecting frame 6, the weight detecting part 8 detects the weight (the force) transferred from the connection frame 6 and the saddle 7 and sends the weight to the whole controller (not illustrated). The whole controller compares the weight applied to the saddle 7 and the weight of the rehabilitation patient, decides whether the height of the saddle 7 is suitable for the characteristic of the rehabilitation patient or not and then decides what the suitable height of the saddle 7 according to the characteristic of the rehabilitation patient is. Consequently, the elevating and lowering frame 5 is controlled to be elevated or lowered suitably with aforementioned method.

LM guides 250, which help the elevating and lowering frame 5 elevate and lower, are respectively installed at both sides inside the vertical supporting part 50 of the weight supporting part 1 of the walk rehabilitation robot according to the present invention. Rotational moment transferred by the weight applied to the saddle 7 is cancelled the LM guides 250 and thus in the weight detecting part 8 the force from the weight of the rehabilitation patient and the like is transferred to the lead screw 246 in the vertically downward direction.

The chest supporting part 140 to support the chest of the rehabilitation patient might be installed in the connecting frame 6. If the rehabilitation patient sits in the saddle 7 and makes the chest contact to the one surface of the chest supporting part 140 and supported, the gait can be trained more stably. Because the chest supporting part 140 is installed to be connected to the connecting frame 6, the weight (the force) applied when the rehabilitation patient supports the chest on the chest supporting part 140 is able to be transferred the weight detecting part 8 through the connecting frame 6.

A couple of the handle 150 to support below armpits of the rehabilitation patient and be taken by hands is installed at the connecting frame 6 in both sides of the chest supporting part 140. If the rehabilitation patient sits on the saddle 7 and then makes the armpits supported below by the handle 150 or grips the handle 150, he can train the gait more stably. Because the handle 150 is installed to be connected to the connecting frame 6, the weight applied when the armpits of the rehabilitation patient leans on the handle 150 or he grips the handle 150, is transferred to the weight detecting part 8 via the connecting frame 6.

On this wise, the weight applied when the rehabilitation patient has a seat on the saddle 7 is transferred to the weight detecting part 8 via the connecting frame 6, but the weight distributed when the rehabilitation patient makes the armpits supported on the handle 150, makes the chest supported on the chest supporting part 140, or grips the handle 150, is transferred to the weight detecting part 8 via the connecting frame 6 so that total weight of the rehabilitation patient sitting on the saddle 7 could be measured exactly.

In the walk rehabilitation robot according to the present invention, because the weight detecting part 8 are separated from the saddle 7 and lies inside the elevating and lowering frame 5, it is easy to open the cover 19 and change or maintenance the weight detecting part 8 inside the elevating and lowering frame 5.

The weight supporting part 1 of the walk rehabilitation robot according to the present invention might be provided apart and used while moving. In this case, the weight supporting part 1 might be contact to the ground and supported by it.

The walk rehabilitation robot according to the present invention provides the convenience because the state of the walk training is adjustable in the state that the rehabilitation patient has a seat on the saddle 7.

In addition, as some parts to tow the rehabilitation patient upwards are needless the upper space required to establish is saved.

Also, the training customized to the characteristic of the rehabilitation patient is possible because the height of the saddle 7 is adjustable according to the characteristic of the rehabilitation patient after exactly measuring the weight applied on the saddle 7 by the rehabilitation patient.

Also, the weight detecting part 7 is installed inside the elevating and lowering frame 5, the maintenance is easy and the volume of the saddle 7 and parts around the saddle 7 is small.

To detect and measure the weight with the detecting part of the walk rehabilitation patient, the location of which is changed, the measured date is analyzed to output the force transferred to the legs of the rehabilitation patient, which is applied to the rehabilitation training and used to control the rehabilitation program.

Figure 14:
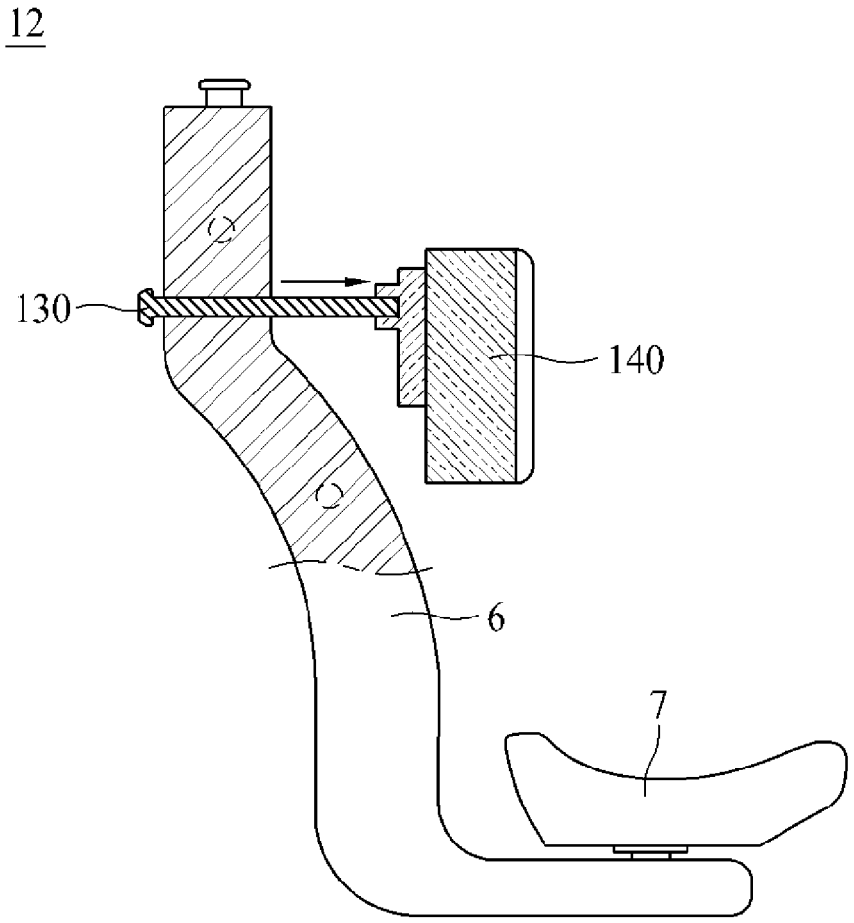
FIG. 14 and FIG. 15 are rough sectional view to explain that the separate distance of the chest supporting part from the connecting frame is adjustable in the weight supporting part of the seating-type walk rehabilitation robot according to the present invention.
Figure 15:
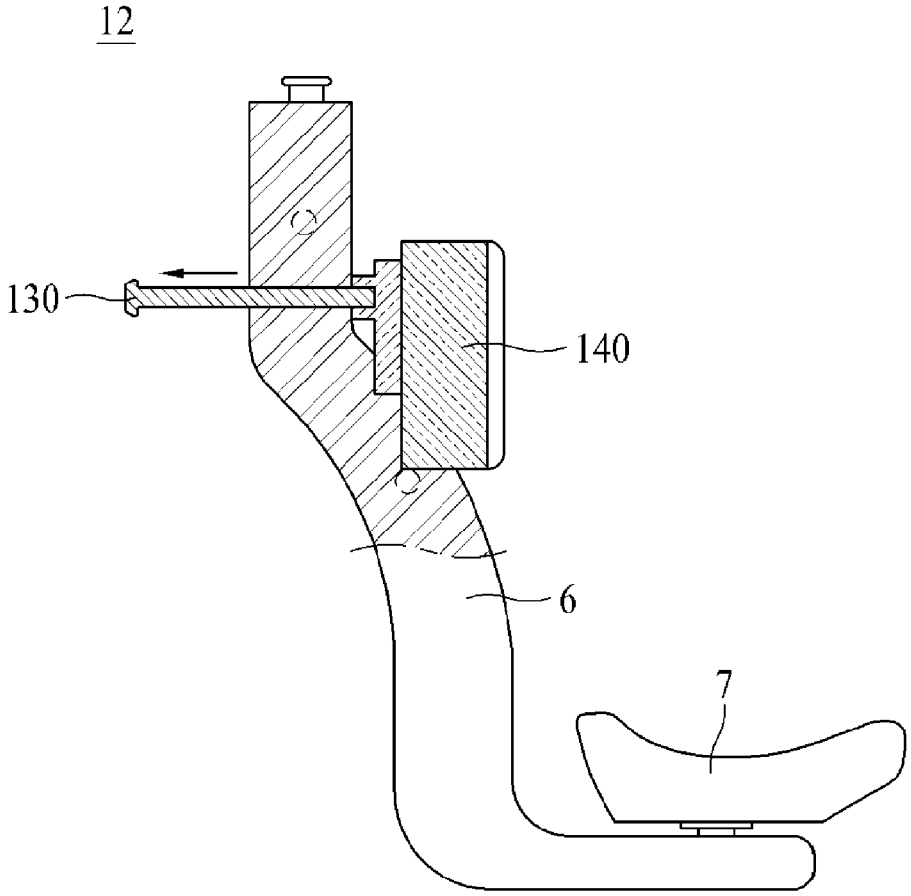
Figure 16:
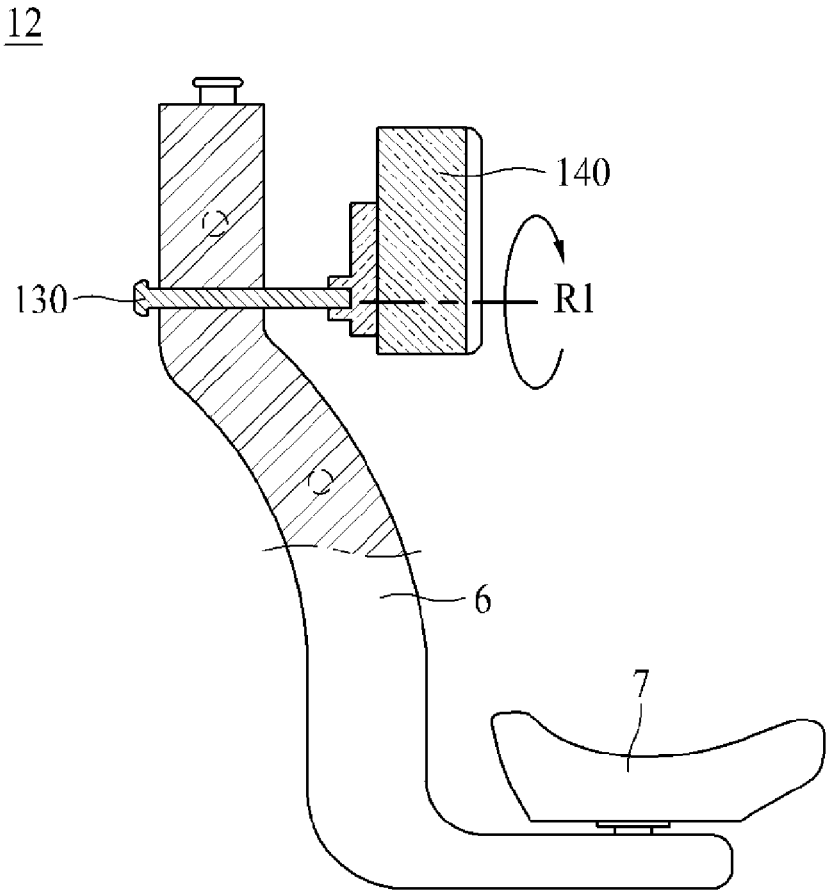
FIG. 16 is a rough sectional view to explain that the chest supporting part rotates in the weight supporting part of the seating-type walk rehabilitation robot according to the present invention.

FIG. 14 and FIG. 15 are rough sectional view to explain that the separate distance of the chest supporting part apart from the connecting frame is adjustable in the weight supporting part of the seating-type walk rehabilitation robot according to the present invention. FIG. 16 is a rough sectional view to explain that the chest supporting part rotates in the weight supporting part of the seating-type walk rehabilitation robot according to the present invention.

Referring to the FIG. 14 and FIG. 15, one side of a chest supporting part adjusting link 130 is combined with the connecting frame 6 to be moveable and rotatable. The other side of the chest supporting part adjusting link 130 is combined with the chest supporting part 140. Upper side of the chest supporting part 140 opposite to lower side where the saddle 7 is located is combined with the chest supporting part adjusting link 130. The chest supporting part adjusting link 130 penetrates the connecting frame 6 and in one side of that a nut or the head of a bolt is located and in the other side of that the chest supporting part 140 is located. The chest supporting part adjusting link 130 might be implemented with a bolt, which is not limited in the present invention, or anything that connects the connecting frame 6 and the chest supporting part 140 and is movable/rotatable relative to the connecting frame 6. The chest supporting part adjusting link 130 is combined with the connecting frame 7 to be parallel with the saddle 7 and vertical with the gravity.

As the chest supporting part adjusting link 130 moves and rotates, the chest supporting part 140 moves and rotates together. For example, if the chest supporting part adjusting link 130 moves to the direction of the saddle 7 from the direction of the connecting frame 6, the chest supporting part 140 moves in the direction far from the connecting frame 6. In this case, because the saddle 7 becomes closer to the chest supporting part 140, it might be good position for a person of small frame such as a child, woman and the like to train the gait. For example, if the chest supporting part adjusting link 130 moves from the connecting frame 6 in the direction far from the saddle 7, the chest supporting part 140 moves in the direction of the connecting frame 6 to be closer to the connecting frame 6. In this case, as the saddle 7 becomes far from the chest supporting part 140, it is good position for the trainee of the big frame such like a male to train the gait.

Referring to the FIGS. 15 and 16, the chest supporting part 140 supports the upper body of the trainee. For this, the chest supporting part 140 is combined with the T-shaped part of the connecting frame 6 shaped in the form of 'L'. The chest supporting part 140 might be combined to the connecting frame 6 through the chest supporting part adjusting link 130. The chest supporting part 140 supports the upper body of the trainee and thus the weight of the trainee on the saddle 7 is distributed. For example, the chest supporting part 140 might support the chest or the stomach to distribute the weight applied on the saddle 7 when the trainee on the saddle 7 makes the upper body lean in the direction of the connecting frame 6. Accordingly, the weight supporting part 1 of the walk rehabilitation robot according to the present invention prevents a problem that the lower body of the trainee is asleep or paralyzed if the weight is applied only on the pelvis and the trainee cannot train for long time. Therefore, the weight supporting part 1 of the walk rehabilitation robot according to the present invention increases the training time and reduces the time required to restore.

The height of the chest supporting part 140 is adjusted. The chest supporting part 140 rotates together as the chest supporting part adjusting link 130 rotates in first direction R1 (as illustrated in FIG. 16), so that the height to support the upper body of the trainee is heightened. For example, if the chest supporting part 140 is in first position before rotating in the first direction then the height is low. In this case, the saddle 7 becomes close to the chest supporting part 140 and it is good position for the short trainee such like a child, to perform the walk training. For example, if the chest supporting part 140 is in second position after rotating in the first direction then it becomes higher. In this case, the saddle 7 becomes far from the chest supporting part 140 and it is good position for the trainee having the big upper body to perform the walk training. Therefore, the weight supporting part 1 of the walk rehabilitation robot according to the present invention increases the convenience of the training as the position of the chest supporting part 140 is adjusted according to the frame or the height of the trainee.

Although the invention has been shown and described with reference to certain exemplary embodiments thereof, the present invention is not limited by the embodiments described above. The various modifications can be made based on the described embodiments and the illustrated figures by those skilled in the art without departing from the spirit and scope of the invention as defined by the appended claims.

What is claimed is:

1. A walk rehabilitation robot, comprising:

a weight supporting part including an elevating and lowering part which is connected to a vertical supporting part and configured to move up and down, and a seating part which is connected to the elevating and lowering part for supporting a trainee who sits on the seating part; and a walk actuating part connected to the weight supporting part and having a couple of weight supporting links which are connected to a couple of footrests and separately mounted side by side on both rear sides of the weight supporting part, wherein the walk actuating part comprising includes:

a first actuating assembly configured to move the weight supporting links in forward and backward directions according to a walk tracking of each footrest, a second actuating assembly configured to move the footrests in upward and downward directions by rotating the weight supporting links with respect to the first actuating assembly, and a third actuating assembly configured to rotate the footrests with respect to the weight supporting links.

2. The walk rehabilitation robot according to claim 1, further comprising:

a weight detecting part configured to measure a weight of the trainee, wherein the elevating and lowering part has an elevating and lowering frame connected to the vertical supporting part, wherein the seating part has a saddle for the trainee to sit on and a connecting frame connected to the saddle, and wherein the elevating and lowering frame is connected to the connecting frame so that the weight detecting part measures the weight of the trainee through the connecting frame.

3. The walk rehabilitation robot according to claim 2, further comprising:

a handle frame connected to the connecting frame, wherein the weight detecting part is configured to measure the weight of the trainee and a load applied to the handle frame through the connecting frame.

4. The walk rehabilitation robot according to claim 2, further comprising:

a chest supporting part connected to the connecting frame, wherein the weight detecting part is configured to measure the weight of the trainee and a load applied to the chest supporting part through the connecting frame.

5. The walk rehabilitation robot according to claim 1, wherein the first actuating assembly comprises:

a first motor installed in a frame of the walk actuating part;

a first reducing device having a reducer or a pulley connected to an output of the first motor;

a first driving pulley connected to an output of the first reducing device;

a first driven pulley connected to the frame of the walk actuating part with being separated from the first driving pulley;

a first actuating table having the weight supporting links mounted thereon and configured to be actuated in forward and backward directions of the frame of the walk actuating part; and a first linear actuating belt connecting one end of the first actuating table and the first driving pulley, and connecting another end of the first actuating table and the first driven pulley.

6. The walk rehabilitation robot according to claim 1, wherein the second actuating assembly comprises:

a second motor mounted on a first actuating table of the first actuation assembly; and a second reducing device connected to an output of the second motor, wherein each of the weight supporting links has one end connected to an output of the second reducing device, and another end connected to each of the footrests, to which the third actuating assembly is connected, and wherein the weight supporting links are configured to be rotated as the first actuating assembly moves linearly in the forward and backward directions.

7. The walk rehabilitation robot according to claim 1, wherein the third actuating assembly comprises:

a third motor connected to each of the weight supporting links; and a third reducer connected to the third motor, an output of the third reducer being connected to a side surface of each of the footrests.

8. The walk rehabilitation robot according to claim 1, further comprising:

a sealing belt wound by rollers which are respectively installed in both forward and backward sides on a first actuating table and passing a frontal upper part of the walk actuating part, a lower part of the first actuating table and a rear upper part of the walk actuating part for hiding the walk actuating part.

9. The walk rehabilitation robot according to claim 2, further comprising:

a trainee moving part connected to the walk actuating part and installed on a ground to assist a movement of the trainee, wherein the trainee moving part comprises:

a tilting part installed in a rear side of the walk actuating part for the trainee to move on the walk actuating part along a slope;

a position adjusting part installed on the walk actuating part so that the trainee moves between a movement position in which the trainee moves on the weight supporting part and a training position in which the trainee performs a walk training; and a guiding part guiding a movement of the position adjusting part.

10. The walk rehabilitation robot according to claim 9, wherein the guiding part comprises, a guide rail providing a moving path of the position adjusting part; and a roller part installed in the position adjusting part and rotating as the position adjusting part moves.

11. The walk rehabilitation robot according to claim 9, further comprising:

a trainee moving part detecting device installed in the guiding part to detect whether the robot is operable when the position adjusting part of the trainee moving part is located at the training position.

12. The walk rehabilitation robot according to claim 1, wherein each of the footrests includes one part connected with another part by an electromagnetic force of an electromagnet installed in each of the footrests, and wherein the one part is separated from the another part by controlling the electromagnetic force not to be generated when load cells installed in each of the footrests detect a pressing force bigger than a predetermined threshold.

13. The walk rehabilitation robot according to claim 12, wherein each of the footrests comprises:

an upper plate having an upper surface on which a fix band is installed to cover the trainee's foot;

a middle plate having a lower surface on which one end of the load cells to detect the pressing force applied to the upper plate is installed, and having an upper surface on which the electromagnet is installed to adhere to a steel block on a lower surface of the upper plate;

a lower plate connected to another end of the load cells; and a footrest detecting part configured to control the electromagnet to lose the electromagnetic force when the load cells detect the pressing force bigger than the predetermined threshold force, thereby separating the upper plate from the middle plate.

14. The walk rehabilitation robot according to claim 13, further comprising:

a footrest assemble state detecting sensor configured to detect whether the upper plate is adhered to the middle plate.

15. The walk rehabilitation robot according to claim 13, further comprising:

elastic members each in a form of a washer being intervened between the middle plate and an upper part of the load cells.

16. The walk rehabilitation robot according to claim 13, wherein a lower surface of the lower plate is in contact with the load cells, and elastic members each in a form of a washer is intervened between the upper surface of the middle plate and a lower side of a bolt, which is disposed through the middle plate.

17. The walk rehabilitation robot according to claim 1, wherein the elevating and lowering part includes an elevating and lowering frame, wherein the seating part includes a connecting frame located in a rear end of the elevating and lowering frame, and a saddle installed in a lower end of the connecting frame wherein a lead screw is installed in the vertical supporting part of the weight supporting part and vertically arranged, and wherein an elevating and lowering block is installed in the lead screw, and moves up or down the elevating and lowering frame with the connecting frame when the lead screw rotates normally or reversely.

18. The walk rehabilitation robot according to claim 1, wherein the elevating and lowering part includes an elevating and lowering frame, wherein the seating part includes a connecting frame located in a rear end of the elevating and lowering frame, wherein a chest supporting part is installed in an upper part of the connecting frame and adapted to support below a chest of the trainee, wherein the chest supporting part is installed in the connecting frame by a chest supporting part adjusting link which is connected to a rear end of the chest supporting part, and wherein a separation distance of the chest supporting part from the connecting frame is adjustable by a movement of the chest supporting part.

19. The walk rehabilitation robot according to claim 18, wherein a height of the chest supporting part is adjustable by rotating the chest supporting part adjusting link.

* * * * *